United States Patent [19]

Ott

[11] Patent Number: 4,733,416

[45] Date of Patent: Mar. 29, 1988

[54] PUSH-BUTTON OPERATING MECHANISM FOR A WATER CLOSET

[76] Inventor: Walter Ott, 16 Rouge St., Markham, Ontario, Canada, L3P 1K8

[21] Appl. No.: 930,731

[22] Filed: Nov. 13, 1986

[30] Foreign Application Priority Data

Nov. 7, 1986 [CA] Canada ..... 522518

[51] Int. Cl.[4] ..... E03D 5/09

[52] U.S. Cl. ..... 4/410

[58] Field of Search ..... 4/410

[56] References Cited

U.S. PATENT DOCUMENTS

| | | | |
|---|---|---|---|
| 1,343,261 | 6/1920 | Griffiths | 4/410 |
| 1,420,948 | 6/1922 | Rathburn | 4/410 |
| 3,234,566 | 2/1966 | Rupp | 4/410 |

FOREIGN PATENT DOCUMENTS

| | | | |
|---|---|---|---|
| 22774 | 5/1935 | Australia | 4/410 |

*Primary Examiner*—Charles E. Phillips

*Attorney, Agent, or Firm*—Sommer & Sommer

[57] ABSTRACT

Disclosed is a push button apparatus for operating a flush valve or the like of a water closet, comprising button actuator means including a button and housing, said housing having a shank for passing through an opening in a water closet tank wall, the button having an actuator within and reciprocally movable relative to said housing shank. Means are provided for securing bracket means to the button shank in a predetermined orientation therewith. Means are provided for actuating lever arm means. Means on the bracket means and the lever actuating means for mounting the lever actuating means for pivotal movement relative to the bracket means upon reciprocal movement of the button actuator operatively contacting the cam means. The mounting means comprises pivot means and pivot socket means with means providing lateral access to the socket means. The pivot means is constructed such that it can be assembled with the socket means translationally through the access means when the pivot means is in a predetermined orientation with respect to the access means.

5 Claims, 10 Drawing Figures

PUSH-BUTTON OPERATING MECHANISM FOR A WATER CLOSET

FIELD OF THE INVENTION

The invention relates to plumbing hardware and more particularly to a water closet operating mechanism for actuating a discharge valve in a flush tank.

BACKGROUND OF THE INVENTION

Pivotally mounted handles to activate a flush discharge valve of a water closet are well known in the art.

Moreover pushbutton flush actuating mechanisms have been developed in place of the pivotal handle types and Canadian Pat. No. 732,787 granted Apr. 26, 1966 (Rupp) is illustrative of these types of pushbutton devices. The Rupp device as well as other pushbutton actuating mechanisms require the use of screws and/or cotter pins to finalize the assembly of the mechanism and they are not, accordingly, economically produced or easy to assemble and to install without various tools.

Although the use of plastic materials have been proposed and used in the development of parts, brackets and levers of pushbutton mechanisms, applicant is not aware of a complete pushbutton mechanism which is easily fabricated and which requires the use of few tools for its assembly and installation.

Accordingly, applicant's invention seeks to provide a pushbutton type mechanism for actuating a flush valve wherein the parts are easily assembled and installed without special tools. The pushbutton type mechanism herein is adaptable to both a "front" lever mechanism and a "side" lever type mechanism, the terms "front" and "side" having relation to the location of the pushbutton on a water closet tank.

SUMMARY OF THE INVENTION

The invention in one broad aspect comprehends push button apparatus for operating a flush valve or the like of a water closet, comprising button actuator means including a button and housing, said housing having a shank for passing through an opening in a water closet tank wall, the button having an actuator within and reciprocally movable relative to said housing shank. Means are provided for securing bracket means to the button shank in a predetermined orientation therewith. Means are provided for actuating lever arm means. Means on the bracket means and the lever actuating means for mounting the lever actuating means for pivotal movement relative to the bracket means upon reciprocal movement of the button actuator operatively contacting the cam means. The mounting means comprises pivot means and pivot socket means with means providing lateral access to the socket means. The pivot means is constructed such that it can be assembled with the socket means translationally through the access means when the pivot means is in a predetermined orientation with respect to the access means.

More particularly, the invention provides a "front" and "side" mounted push button apparatus including snap fitting connections between the button actuator and the shank of the button housing. Further a cam element is snap fitted to the actuator. The bracket preferably includes spaced lugs extending therefrom which provide pivot sockets. A slot extends from the sockets so that they can be accessed from the periphery of the lugs. The lever actuating means for a "side" mounted device includes integral pivot means which have portions which can pass through the slots so that the lever actuating means may be pivotably mounted with the pivots in the pivot sockets.

Accordingly the apparatus can be of plastic and assembled and installed without the need of screws, cotter pins or the like.

The apparatus also contemplates a "front" mounted device wherein the lever actuating means includes a lever arm having a pivot portion mounted through a slotted access to pivot socket means laterally spaced from a pivotal cam portion of the lever actuating means. The cam portion of the lever actuating means is in the form of a cam lever having a slot adapted to accommodate a portion of the lever arm at right angles to the pivot portion so that movement of the cam lever moves the lever arm.

Other aspects and advantages of the invention will become apparent from the description of preferred embodiments herein.

DESCRIPTION OF THE PREFERRED EMBODIMENTS

Figure 1:
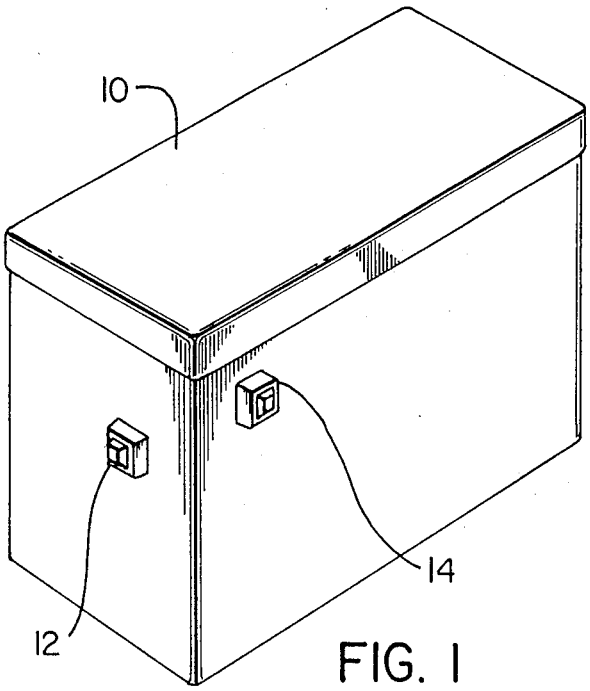
FIG. 1 is a perspective view of a water closet tank showing the outer location of side and front pushbutton operating mechanisms.

Turning to FIG. 1, there is shown, simply for illustrative purposes, a water closet tank 10 of conventional construction with a "side" mounted pushbutton operating mechanism 12 for flushing the water closet and a "front" mounted pushbutton operating mechanism 14. It will be appreciated that only one of these mechanisms 12 and 14 is on any one tank.

Figure 2:
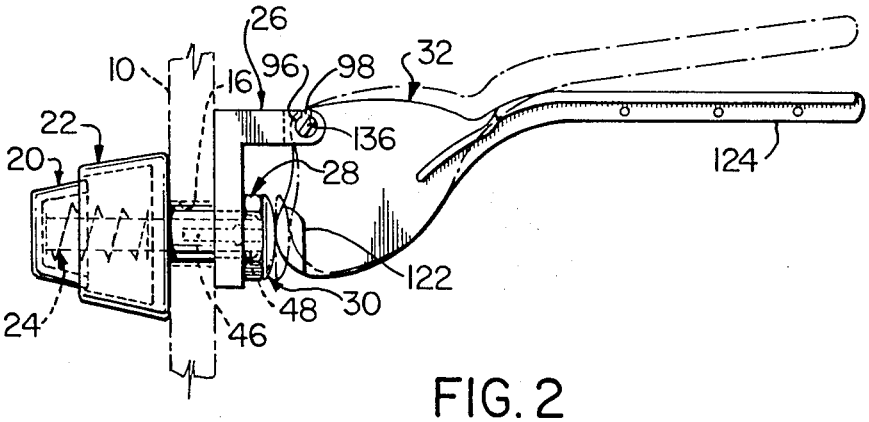
FIG. 2 is a side view of the assembled "side" lever operating mechanism of the invention.

FIG. 2 shows a side view of the operating mechanism 12 in association with tank 10, a side wall of which is shown in dotted lines. Tank 10 has an appropriate aperture 16 through its side wall. Since the tank 10 is conventional, no further description of the tank is considered necessary.

The button operating mechanism 12 basically comprises seven parts, a button element 20 reciprocal within housing 22. Coil spring 24, operative between the button 20 and housing 22, biases button 20 outwardly relative to housing 22. Mechanism 12 further includes lever support bracket 26, threaded nut 28, cam 30 and lever actuating means 32.

Except for coil spring 24, all of the above elements are molded or otherwise formed of suitable plastic material such as ABS plastic or polypropylene.

Figure 3:
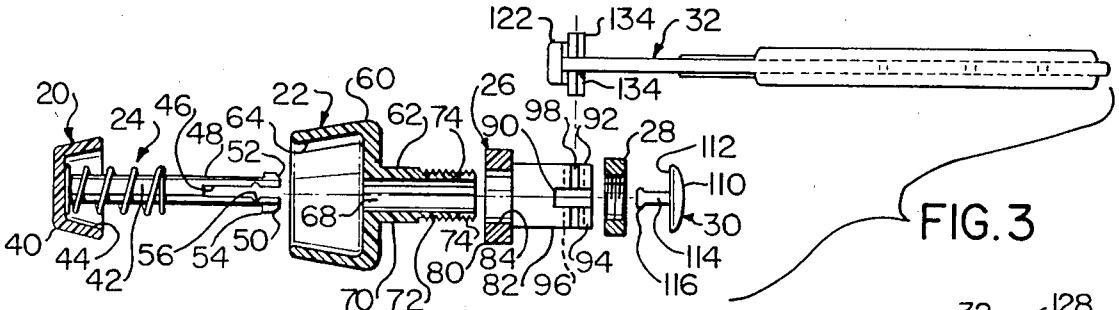
FIG. 3 is a disassembled exploded view of the "side" lever mechanism of FIG. 2, viewed from the opposite side.
Figure 4:
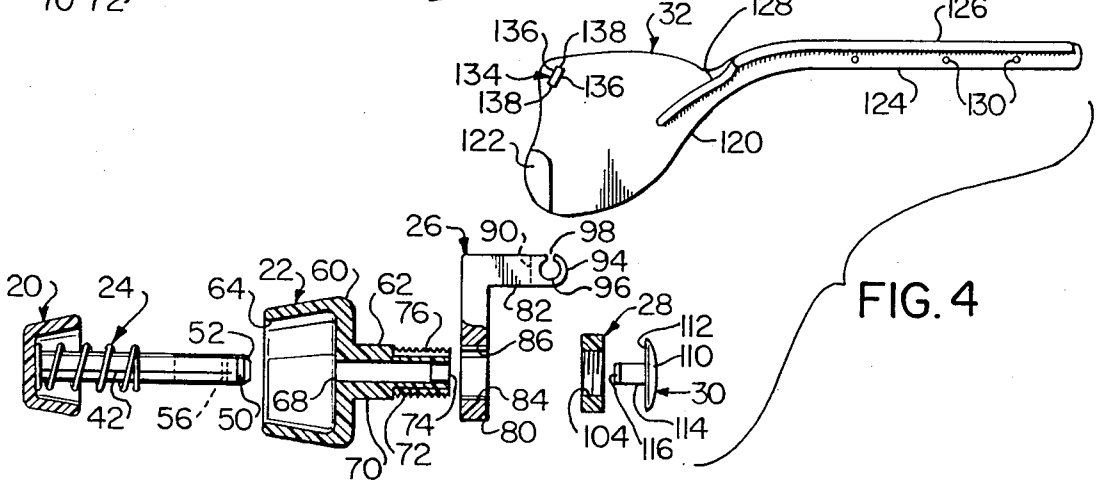
FIG. 4 is a disassembled, exploded view of the "side" lever mechanism similar to FIG. 3, but wherein the parts are rotated 90°.
Figure 5:
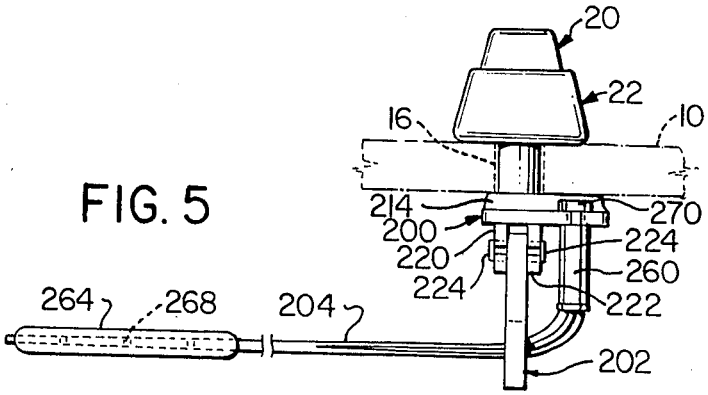
FIG. 5 is a view of the assembled "front" lever operating mechanism of the invention.
Figure 6:
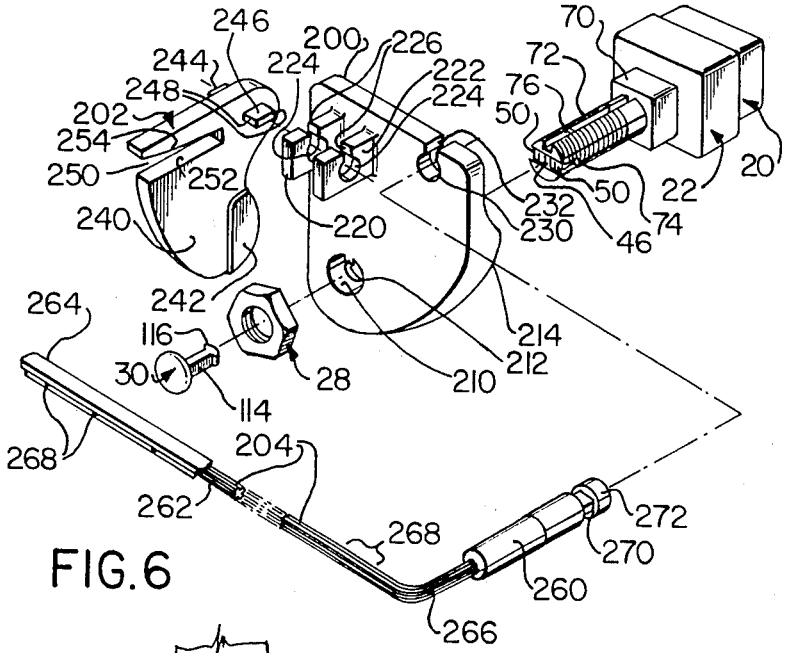
FIG. 6 is a disassembled exploded view of the "front" lever mechanism of FIG. 5.

Turning more particularly to FIGS. 3 and 4, button 20 has recessed head portion 40 and shank portion 42, spring 24 being carried about shank portion 42. Head portion 40 includes recess 44 providing a back support for one end of spring 24. Shank portion 42 includes distal end slot 46 which provides bifurcated end portions 48 each having a slightly laterally enlarged end 50 having a slanted face 52 and rearward shoulder 54. The inside surface of bifurcated ends 48 include opposing recesses 56, the purpose of which will become more apparent herein.

Button housing 22 includes head portion 60 and shank portion 62. Head portion 60 includes recess 64 which defines a surface surrounding aperture 68 against which spring 24 is biased. Shank 62 includes generally squarish portion 70 and circular threaded portion 72, aperture 68 extending axially through both. Threaded portion 62 includes diametrically opposed end slots 74, the depth of end slot 74 being similar to the axial thickness of laterally enlarged portions 50 of button 20. Threaded portion 72 also has an axially extending groove 76 for purposes which will become more apparent herein.

Lever support bracket 26 includes flat plate portion 80 and pivot support portion 82. Plate portion 80 includes aperture 84 having a diametric extent so that it may telescope over threaded portion 72 of button housing 22. However, in order to keep the rotational orientation of button housing 22 and bracket 26 fixed, aperture 84 includes radially inwardly directed projection 86 which is sized to be slidingly received by groove 76.

Pivot support section 82 is bifurcated by slot 90 providing two pivot lugs 92 and 94. Pivot lugs 92 and 94 have aligned circular pivot apertures 96 and access slots 98, the width of the slots 98 being less than the diametric extent of apertures 96.

Nut 28 has threaded internal aperture 104, the threads being complementary with the threads of threaded shank portion 72 of button housing 22.

Cam member 30 has circular and rounded head 110 with flat back surface 112. Cam shank 114 is rectangular in cross-section and has a laterally extending bulbous end portion 116 which bulbous end portion 116 is sized and shaped to be received within recesses 54 of button shank slot 46.

Lever means 32 includes plate portion 120 having camming element 122 of greater lateral extent as shown in FIG. 3. Lever means 32 includes arm portion 124 with reinforcing flange 126 and reinforcing rib 128 associated therewith. Openings 130 in arm portion 124 provide the necessary apertures to which some means such as a chain (not shown) is connected between the operating mechanism and the flush ball or plunger (not shown) in water closet tank 10.

Lever means 32 includes laterally extending pivots 134, each pivot 134 having opposing flat sides 136 and opposing arcuate sides 138. The diametric extent between the arcuate sides 138 is such as to allow lever member 32 to pivot when pivots 134 are within the respective circular pivot apertures 96. The thickness of pivot 34 between opposing flat sides 136 is such as to permit insertion of the pivots 134 through respective slots 98 in pivot support portion 82.

Assembly and installation of the operating mechanism 12 after fabricating the individual parts and components (with the exception of spring 24) will be apparent from the previous description and drawings referred to. However, for additional clarity, it will be appreciated that spring 24 is applied over shank 42 and shank 42 is inserted through aperture 68 of housing 22. This insertion causes a slight flexing of bifurcated ends 48 and when button 20 is in proper location, bifurcated ends 48 will snap back into position wherein shoulders 52 are in contact with the respective end walls of slots 74.

Shank 62 of the assembled button and housing is inserted through the appropriate aperture 14 in tank 10 so that at least square portion 70 is therewithin. Aperture 84 of flat plate portion 80 of bracket 26 is telescoped over threaded shank 72 with projection 86 sliding in longitudinal groove 76 until flat portion 80 is flat against the inside wall of tank 10. Nut 28 is then threaded on shank 72 to hold the button housing 22 and plate 80 securely to the tank 10. Shank 114 of cam 30 is inserted in slot 46 of button shank 42 in such manner that bulbous end 116 snaps into recesses 56 of button shank 42. Lever means 32 is rotated in such fashion that pivots 134 pass through slots 98 into pivot aperture 96. Any appropriate chain or like device (not shown) may then be hooked to one of the openings 130 of lever portion 124 so that the flush ball or valve (not shown) is operative upon depression of button 20. (Lever arm 32 is shown in chain line upon depression.) By its nature and construction, lever means 32 returns to its normal position as shown in FIG. 2 after spring 24 biases button 20 away from housing 22 (FIG. 2).

Accordingly it will be apparent that I have provided an effective but simple "side" pushbutton mechanism which may be assembled quickly without difficulty and which is adapted to lightweight construction since all parts, with the exception of spring 24 may be molded of plastic and snap fitted or otherwise easily assembled together.

Turning now to FIGS. 5–8 which illustrate a "front" mounted pushbutton mechanism of the invention, button 20, housing 22, nut 28 and cam 30 are all of the same construction as shown in FIGS. 2–4 and no further description thereof is considered necessary. The same reference numbers as used in FIGS. 2–4 have been used in FIGS. 5–8.

The "front" mounted lever mechanism 14 however differs from the "side" mounted lever mechanism 13 in the lever support bracket 200, the lever actuating means comprising cam lever 202 and lever arm 204.

Bracket 200 has aperture 210 having a diametric extent so that it may telescope over threaded portion 72 of button housing 22. Aperture 210 includes radially inwardly directed projection 212 which is sized to be slidingly received by groove 76.

Bracket 200 has a thicker portion 214 about aperture 210 which acts as a spacing means for reasons which will become apparent herein. Bracket 200 has outwardly extending, spaced apart, lugs 220, 222, each of which has a pivot aperture 224 and access slot 226. Laterally spaced from lugs 220, 222 is aperture 230 also having access slot 232, the axis of aperture 230 being generally perpendicular to and planar with the axis of aperture 224.

Cam lever 202 includes plate portion 240 having camming element 242 of greater lateral extent than portion 240. Laterally extending pivots 244 each have opposing flat sides 246 and opposing arcuate sides 248.

The diametric extent between arcuate sides 248 is such as to allow cam lever 202 to pivot when pivots 244 are within respective circular pivot apertures 224. The thickness of pivots 244 between opposing flat sides 246 is such as to permit insertion of the pivots 244 through respective slots 226 in pivot support lugs 220, 222.

Plate portion 240 of cam lever 202 has inwardly directed mouth or opening 250 having generally flat bottom edge 252 and arcuate upper edge 254. The width and depth of opening 250 is such that it can accommodate a portion of lever arm 204 as set out more fully herein.

Lever arm 204 includes pivot portion 260 and arm portion 262 generally at right angles thereto. Arm portion 262 includes reinforcing flange 264 and reinforcing rib 266 associated therewith. Openings 268 provide the necessary apertures to which some means such as a chain (not shown) is connected between the operating mechanism and a flush ball or plunger (not shown) in water closet 10.

Pivot portion 260 of lever arm 204 includes pivot means 270 which has a reduced cross-sectional dimension relative to portion 260 between end 272 and portion 260. The shape of pivot means 270 is shown in more detail in FIG. 7 and includes opposed flat sides 276 and opposed arcuate sides 278. The diametric extent between arcuate sides 278 is such as to allow lever arm 204 to pivot when pivot means 270 is within aperture 230. The thickness of pivot 270 between opposing flat sides 276 and the width of the reduced portion is such as to permit insertion of pivot 270 through slot 232 in support bracket 200.

Assembly and installation of the "front" operating mechanism 14 after fabricating the individual parts and components (with the exception of spring 24) will be apparent from the previous description and drawings referred to. However, for additional clarity, it will be appreciated that button 20 and housing 22 are assembled in accordance with the previous descriptions pertaining to the "side" mounted lever mechanism. Shank 62 of the assembled button and housing is inserted through the appropriate aperture 14 in tank 10 so that at least square portion 70 is therewithin. Aperture 210 of bracket 200 is telescoped over threaded shank 72 with projection 212 sliding in groove 76 until portion 214 is flat against the inside wall of tank 10. Nut 28 is then threaded on shank 72 to hold the button housing 72 and bracket 200 securely to tank 10. Shank 114 of cam 30 is then inserted in slot 46 of button shank 42 in such manner that bulbous end 116 snaps into recess 56 of button shank 42.

Figure 7:
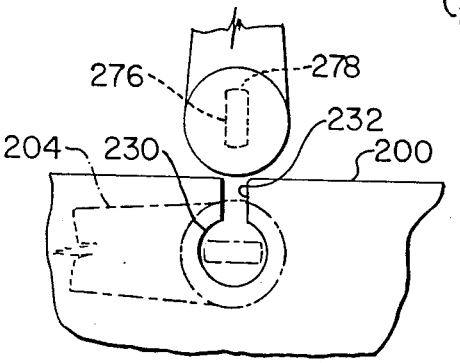
FIG. 7 is a partial view of the lever arm pivot and pivot aperture in the support bracket.

Lever arm 204 is oriented in such manner (FIG. 7) whereby pivot means 270 is inserted through slot 232 into aperture 230. As shown in FIG. 7, the pivot 270 is constructed such that lever arm 204 is generally upright when assembled with support bracket 200 and rotates about 90° to its normal operating position shown in dotted lines in FIG. 7.

Figure 8:
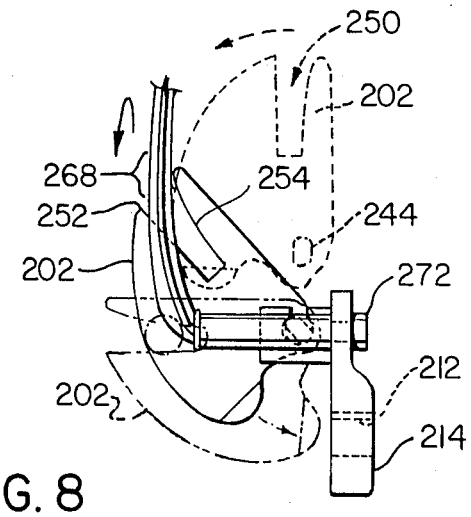
FIG. 8 is a partial side view of the cam lever and its pivotal connection with the plate and showing the connection of the lever arm with the cam lever.

Cam lever 202 is oriented as shown in dotted lines in FIG. 8 so that pivots 244 may be inserted into pivot apertures 224 through slots 226. Cam lever 202 and lever arm 204 are then each rotated in such fashion that portion 268 of lever arm 204 is inserted into the mouth 150 of lever 202. The two components, cam lever 202 and lever arm 204 are then each rotated downwardly whereupon lever arm 204 is cammed by the upper edge 254 of mouth 250 into its operating position shown in "chain" lines in FIG. 8.

Accordingly, applicant has provided both a "front" lever mechanism and a "side" lever mechanism which are each comprised of easily fabricated plastic material, interfitting in an appropriate manner wherein no screws, cotter pins or other fastening means are required. The only tool required is a spanner wrench or the like to tighten nut 28 during installation.

Figure 9:
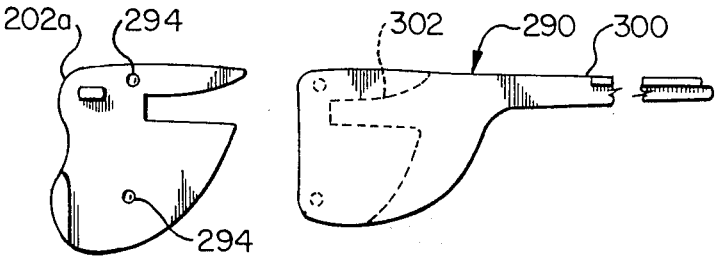
FIG. 9 is a side view of a modified embodiment of the cam lever and lever arm; as shown with FIG. 5.
Figure 10:
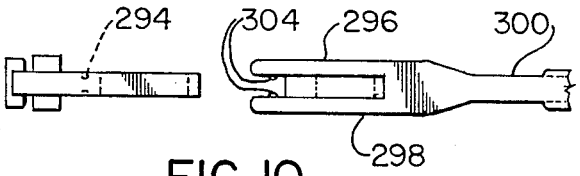
FIG. 10 is a top view of the modified embodiment of FIG. 9; as shown with FIG. 5.

Various modifications will be apparent to those skilled in the art. By way of example, bracket 200 designed for front mounted lever mechaniams could be used as the support bracket for side mounted lever mechanisms, in which case the slot 232 and aperture 230 would not be used. Such use would require only one mold and the inventory of only one bracket. Further, although lever arm portion 124 is shown as integral with plate portion 120 of lever arm 32 in FIG. 4 of the side mounted mechanism 12, it will be appreciated that lever arm 32 of FIG. 4 could be fabricated in two parts, a cam lever part such as cam lever **202*a*, FIGS. 9 and 10, and a separate part 290 which may be secured thereto. More particularly, cam lever 202*a* has indentations or recesses 294 molded therein and part 290 is molded or fabricated with side plates 296 and 298 integral with arm portion 300, the profile between plates 296 and 298 shown in dotted line 302 being complementary to the forward profile of cam lever 202*a*. Projections 304 molded into the inner side of side plates 296, 298 would coincide with indentations 294. The spacing of side plates 296 and 298 and their flexibility is such that a snug fit is provided when part 290 is snap assembled to cam lever 202*a***.

Accordingly, applicant's invention provides a means of using the cam lever **202*a*** for both front and side mounted mechanisms thereby saving on inventory.

Although a preferred embodiment has been set forth hereinabove, it will be apparent that various modifications are within the scope of the invention and the scope of such variations is not to be limited by the disclosure hereinabove but by the scope of the claims appended hereto.

The embodiments of the invention in which an exclusive property or privilege is claimed are defined as follows:

1. Push button apparatus for operating a flush valve or the like of a water closet, comprising:

button actuator means including a button and housing, said housing having a shank for passing through an opening in a water closet tank wall, said button having an actuator within and reciprocally movable relative to said housing shank, said button actuator including flexible bifurcated shank means, at least one shank means having a laterally enlarged end portion engageable with said housing shank to prevent unintended separation of said button form said shank, at least one of said bifurcated shank means including a groove on the inside surface thereof, and said button actuator including a cam element having a shank, said cam shank having a lateral end portion adapted to mate with said groove;

bracket means;

means for securing said bracket means in operative association with said button shank in a predetermined orientation therewith;

lever arm means;

means for actuating said lever arm means;

means on said bracket means and said lever actuating means for mounting said lever actuating means for pivotal movement relative to said bracket means upon reciprocal movement of said button actuator operatively contacting said lever actuating means;

said mounting means comprising pivot means and pivot socket means, means providing lateral access to said socket means, said pivot means being constructed such that it can be assembled with said socket means translationally through said access means when said pivot means is in a predetermined orientation with respect to said access means.

2. The push button apparatus of claim 1 wherein said housing shank having at least one slot means adjacent its distal end, said slot means of a configuration whereby said laterally enlarged end portion snap fits therein.

3. The push button apparatus of claim 1 wherein said bracket means includes pivot aperture means laterally spaced from the mounting means on said bracket, lateral access means to said aperture means, said means for actuating said lever arm means including a cam actuator having slot means therein, said lever arm having a portion including pivot means which is constructed such that it can be mounted with said aperture means translationally through said aperture means when said arm pivot means is in a predetermined orientation with respect to said aperture access means, said lever arm having a portion substantially at right angles to said pivot portion means, said lever arm and cam actuator being respectively mountable such that when in operative association, a part of said right angle portion of said lever arm passes through said slot means.

4. The push button apparatus of claim 1 wherein said means for actuating said lever arm include a cam actuator integrally formed with said lever arm, and said pivots being integrally formed on said cam actuator, said lever arm extends in the same axial direction as said button actuator.

5. The push button apparatus of claim 1 wherein said means for actuating said lever arm means includes a cam actuator having slot means therein, said lever arm means having means for complementary snap fitting connection with said cam actuator adjacent said slot means, said lever arm extending in the same axial direction as said button actuator.

* * * * *